US005664881A

United States Patent [19]

Hawkins et al.

[11] Patent Number: 5,664,881

[45] Date of Patent: *Sep. 9, 1997

[54] COUNTER-FLOW ASPHALT PLANT WITH MULTI-STAGE COMBUSTION ZONE OVERLAPPING THE MIXING ZONE

[75] Inventors: Michael Hawkins, Kansas City, Mo.; Robert E. Schreter, Roswell, Ga.

[73] Assignee: Maxam Equipment, Inc., Kansas City, Mo.

[ * ] Notice: The term of this patent shall not extend beyond the expiration date of Pat. No. 5,364,182.

[21] Appl. No.: 338,333

[22] Filed: Nov. 14, 1994

Related U.S. Application Data

[63] Continuation-in-part of Ser. No. 153,604, Nov. 16, 1993, Pat. No. 5,364,182.

[51] Int. Cl.[6] ..... B28C 1/22; B28C 5/46

[52] U.S. Cl. ..... 366/4; 366/5; 366/7; 366/11; 366/25

[58] Field of Search ..... 366/4, 5, 6, 7, 366/11, 12, 22, 23, 24, 25, 40, 144, 147, 148; 432/14, 19, 109, 111; 106/273.1, 281.1, 276

[56] References Cited

U.S. PATENT DOCUMENTS

| | | | |
|---|---|---|---|
| 2,421,345 | 5/1947 | McConnaughay . | |
| 4,075,710 | 2/1978 | Jakob | 366/25 |
| 4,143,972 | 3/1979 | Benson | 366/25 |
| 4,787,938 | 11/1988 | Hawkins . | |
| 4,892,411 | 1/1990 | Elliott et al. . | |
| 4,910,540 | 3/1990 | Murray . | |
| 4,913,552 | 4/1990 | Bracegirdle . | |
| 4,948,261 | 8/1990 | Marconnet . | |
| 4,954,995 | 9/1990 | Marconnet . | |
| 4,955,772 | 9/1990 | Marconnet . | |
| 4,988,207 | 1/1991 | Marconnet . | |
| 4,989,986 | 2/1991 | Swisher, Jr. . | |
| 5,002,398 | 3/1991 | Musil . | |
| 5,052,809 | 10/1991 | Young . | |
| 5,054,931 | 10/1991 | Farnham et al. . | |
| 5,073,030 | 12/1991 | Banks . | |
| 5,085,581 | 2/1992 | Mendenhall . | |
| 5,190,454 | 3/1993 | Murray et al. . | |
| 5,193,935 | 3/1993 | Musil . | |
| 5,334,012 | 8/1994 | Brock et al. . | |

OTHER PUBLICATIONS

CMI News, Winter 1993.

CMI Leading the Hot Mix Industry In . . . Asphalt Production Equipment (No Date).

*Primary Examiner*—Tony G. Soohoo

*Attorney, Agent, or Firm*—Kokjer, Kircher, Bowman & Johnson

[57] ABSTRACT

A drum mixer is provided with a rotatable cylinder in which aggregates, reclaimed asphalt pavement and liquid asphalt are mixed to produce an asphaltic composition. The drum cylinder includes a first region, in which virgin aggregate is heated and dried by heat radiation and the stream of hot gases produced by a burner flame flowing in countercurrent flow to the aggregate itself to establish a highly beneficial heat transfer relationship. A second region doubles as combustion and mixing zones. In the mixing zone the reclaimed asphalt pavement and liquid asphalt is added and mixed with the aggregates. The combustion zone is formed along the center of the mixing zone by an elongated combustion assembly disposed along the central axis thereof. The combustion assembly and chamber extend from the discharge end of the drum through the mixing zone to the heating and drying zone to segregate the hot gases from the asphalt, thereby preventing degradation of the final product. The hot gas stream is withdrawn from the drum cylinder at the upstream or inlet end thereof and delivered by ductwork to air pollution control equipment. Accordingly, while the liquid asphalt, recycle material and virgin aggregate are mixed in the mixing zone in an annular region between the drum cylinder and the combustion assembly, contact with the burner flame or with the hot gas stream is eliminated.

13 Claims, 3 Drawing Sheets

COUNTER-FLOW ASPHALT PLANT WITH MULTI-STAGE COMBUSTION ZONE OVERLAPPING THE MIXING ZONE

BACKGROUND OF THE INVENTION

This is a continuation-in-part of Ser. No. 08/153,604, filed Nov. 16, 1993, now U.S. Pat. No. 5,364,182 by Michael Hawkins entitled "Counter-Flow Asphalt Plat With Multi-Stage Combustion Zone Overlapping The Mixing Zone".

The invention generally relates to a drum mixer asphalt plant used to produce a variety of asphalt compositions. More directly, the invention relates to a drum mixer in which a first region contains a heating/drying zone and a second region doubles as combustion and mixing zones, to shorten the drum cylinder's overall length, and in which the combustion zone is separated into multiple chambers to stage combustion for greater efficiency, reduced emissions and isolation of hot combustion gases from materials containing hydrocarbons.

Several techniques and numerous equipment arrangements for the preparation of asphaltic cement, also referred by the trade as "hotmix" or "HMA", are known in the prior art. Particularly relevant to the present invention is the production of asphalt compositions in a drum mixer asphalt plant. Typically, water-laden virgin aggregates are heated and dried within a rotating, open-ended drum mixer through radiant, convective and conductive heat transfer from a stream of hot gases produced by a burner flame. As the virgin aggregate flows through the drum mixer, it is combined with liquid asphalt and mineral binder to produce an asphaltic composition as the desired end-product. The drum mixer also generates, as by-products, a gaseous hydrocarbon emission (known as blue smoke) and sticky dust particles covered with asphalt.

Exposing the liquid asphalt to excessive temperatures within the drum mixer or in close proximity with the burner flame causes serious product degradation, in addition to health and safety hazards. In such event, the more volatile organic compounds (VOCs) of the asphalt are released and the final product may become unfit for use in paving operations. It is desirable to retain the VOCs, within the final product, to render it more flexible and workable. Also, excessive heating of an asphalt composition results in a substantial air pollution control problem, due to the blue-smoke that is produced when hydrocarbon constituents in the asphalt are driven off and released into the atmosphere. Significant investments and efforts have been made by the industry in attempting to control blue-smoke emissions.

Optionally, prior to mixing the virgin aggregate and liquid asphalt, reclaimed asphalt pavement (RAP) may be added once it is ground to a suitable size. The RAP is mixed with the virgin aggregate, in the drum mixer, at a point prior to mixing with the liquid asphalt. The asphalt within the RAP creates the same problems as discussed above in connection with the liquid asphalt. The VOCs within the RAP are released upon exposure to high temperatures and carried in the exhaust gases to the air pollution control equipment, typically a baghouse. Within the baghouse, the blue-smoke condenses on the filter bags and the asphalt-covered dust particles stick to and plug-up the filter bags, thereby presenting a serious fire hazard and reducing their efficiency and useful life.

Conventional systems attempt to avoid the above-noted problems by using a "counter-flow" technique in which the flames and hot gas stream are directed in a direction opposite to the direction of movement of the aggregate material.

One conventional system (U.S. Pat. No. 2,421,345) discloses a counter-flow drum mixer having an aggregate feeder located at an inlet end and a burner head located at a material discharge end opposite to the inlet end. The discharge end of the drum concentrically communicates with, and extends into, a stationary cylindrical casing. The overlapping portions of the drum and casing form a mixing zone therebetween. Mixing blades are affixed to the drum and extend radially outward to the casing. As the drum rotates the blades mix the aggregate with a binder added through a spray bar extending into the mixing zone from the discharge end. To prevent the aggregate/binder mixture from directly contacting a flame from the burner head, while in the mixing zone, an annular shield is axially mounted in the drum to extend through the mixing zone. This shield serves as a conduit for the gases discharged by the burner.

However, as taught by a more recent conventional system (U.S. Pat. No. 4,955,722) the system of the '345 patent was unable to incorporate spent coatings, such as RAP, into the aggregate/binder mixture. Also, in the system of the '345 patent, the burner flame was generated in the mixing zone, thereby giving rise to the formation of bitumen vapors, even when the annular shield is mounted in the center of the mixing chamber.

In recent counter-flow systems (such as U.S. Pat. No. 4,787,938, hereby incorporated by reference), the burner head is extended into, and is located at an intermediate point within, the drum cylinder. These counter-flow mixer drums characteristically include three zones (see U.S. Pat. Nos. 4,892,411; 4,910,540; 4,913,552; 4,948,261; 4,954,995; 4,988,207 and 5,054,931). The three zones include a combustion zone beginning immediately downstream of the burner head, a heating/drying zone further downstream which extends from the combustion zone to the opposite end of the drum (i.e., the gas discharge end) and a mixing zone which extends from the burner head upstream to the outlet end of the drum (i.e., the product discharge end).

When the virgin aggregate is loaded at the gas discharge end in the heating/drying zone, it is cascaded through the drum mixer and shifted upstream past the combustion zone and toward the product discharge end. The RAP, liquid asphalt and fines are added to the aggregate material at varying points behind or upstream the burner head, between the burner head and the outlet end, to avoid direct exposure to the hot gases. To further isolate the RAP and liquid asphalt from the flame, these systems propose surrounding the flame with a burner shield. The aggregate and RAP pass along the outside of the shield, while the flames and gas pass through its center. The system of the '995 patent facilitates isolation by using vanes along the inner perimeter of the mixer drum and adjacent the flame to carry the material beyond the burner head and flames. The system of the '540 patent achieves isolation by enclosing the burner head and flame within first and second telescoping pipes. The telescoping pipes run from the burner head, intermediate the drum, along a majority of the remaining length of the mixer.

However, none of the conventional counter-flow systems are readily incorporated into existing concurrent flow mixer drums (i.e. drums in which the aggregate and hot gas stream are introduced at the same end and travel in the same direction). The above noted counter-flow systems, that are able to combine RAP, liquid asphalt, fines and aggregate, use mixing, combustion, and heating/drying zones arranged end-to-end along the length of the drum mixer, thereby requiring an extremely long and specially designed drum cylinder. Conventional concurrent-flow systems use shorter drum cylinders, and thus cannot be converted to a counter-flow system since the drum cylinders are too short to accommodate the three stage arrangement.

Further, none of the conventional counter-flow systems are readily incorporated into existing counter-flow batch-plant dryers. Briefly, a batch-plant dryer includes a cylindrical mixer drum receiving aggregate at an inlet end and producing a hot gas stream at a discharge end. The aggregate is heated and dried in the mixer drum as it flows in a direction opposite to the hot gas stream and expelled at the discharge end. Once expelled from the dryer, the hot aggregate is carried via a bucket elevator to a batch tower where the aggregate is mixed with liquid asphalt, dumped into a truck and carried to the job site. However, these batch-plant dryers are also to short to accommodate the three-stage arrangement of the previous counter-flow systems.

Moreover, past concurrent-flow mixer drums experience low heating efficiency, thereby limiting the percentage of RAP which may be used within the resulting asphalt composition. Additional inefficiencies result, in both counter-flow and concurrent-flow systems, from veiling of the aggregate material through the flame which quenches the flame.

Further, conventional concurrent-flow mixer drums offer little, if any control, over the temperature of the flame and hot gas stream within the combustion zone, typically heating to a temperature of 3200° F. or more. At such high temperatures, an undesirably large amount of nitrogen oxide (NOX) is produced within the combustion zone. Conventional counter-flow mixer drums attempt to minimize the concentration of NOX emitted by the combustion zone by significantly increasing the volume of air that is blown through the combustion zone. This increase in air flow reduces the NOX emissions in two ways. First, it dilutes the percentage of NOXs in a given volume of air and, second, it reduces the temperature within the combustion zone thereby diminishing the quantity of NOX that is produced.

However, increasing the volume of air flowing through the combustion zone creates other problems. First, it requires a larger blower fan to generate the air and a larger baghouse to filter the exhaust gases emitted by the mixer drum, thereby increasing the systems overall cost. In fact, past counter-flow systems typically operate with an air volume 1½ to 3 times greater than that necessary for complete combustion of the fuel. Secondly, increasing the air volume may reduce the temperature within the combustion zone below a level necessary for complete combustion of the fuel. When operating below this minimum temperature, the combustion zone produces excess carbon monoxide (CO), which is also undesirable. Consequently, previous counter-flow systems continuously performed a balancing act to minimize NOX emissions without overcooling the combustion zone and producing CO emissions.

Finally, most conventional counter-flow mixer drums cannot provide adequate radiant heat from the combustion chamber to the mixing zone since the entire mixing zone is upstream of the combustion zone. Some conventional counter-flow systems allow material, including at least virgin aggregate, to pass through the combustion zone thereby quenching the flame and reducing the overall efficiency.

The need remains in the asphalt industry for improved drum mixer design and operating techniques to address the problems and drawbacks heretofore experienced. The primary objective of this invention is to meet this need.

SUMMARY OF THE INVENTION

An object of the invention is to provide a drum mixer having a first region as a heating/drying zone and a second region in which combustion and mixing zones overlap to shorten the overall drum cylinder length and to provide an easy manner for converting a conventional concurrent-flow mixer drum or a counter-flow batch plant dryer to a counter-flow mixer drum.

Another object of the invention is to provide a multi-staged combustion zone within the drum mixer, having air intakes along a length thereof, that burns more efficiently, produces fewer emissions and provides radiant heat to the mixing zone while isolating the flame and hot gas stream from the RAP, liquid asphalt and fines.

A corollary object of the invention is to provide a combustion zone that is able to pre-heat the mixing zone through radiant heat emitted from the walls of the multi-stage combustion chamber.

Another object of the invention is to control precisely the temperature within the combustion zone to avoid excessively high and overly low temperatures, thereby minimizing production of nitrogen oxide and carbon monoxide, respectively, and reducing baghouse maintenance costs by reducing the exhaust temperature and the percentage of pollutants in the exhaust.

A further corollary object of the invention is to control the heat flux transmitted to the mixing zone to reduce boiling off of light hydrocarbon fractions.

An additional object of the invention is to increase the percentage of reclaimed asphalt material that is included within the resulting asphalt composition and to allow low flash point additives to be introduced into the resulting asphalt composition.

A further object of this invention is to provide a drum mixer of the type described which reduces the amount of hydrocarbons released to the environment by recycling the blue smoke from the mixing zone through the combustion zone to ensure that it burns clean and by completely isolating the RAP and liquid asphalt from the flame.

Another object of the invention is to provide a counter-flow drum mixer in which the burner flame is isolated from veiling aggregate thereby reducing flame quenching and the production of carbon monoxide.

Another object of the invention is to improve mixture quality by retaining more volatile organic compounds (VOCs), also known as "light ends", within the mixture by avoiding exposure of the mix to the hot gas stream, thereby making the mix more workable and longer-lasting.

Another purpose of the invention is to provide a means for incinerating hydrocarbon vapors and blue smoke by entraining these vapors and/or gases in the reactive portion of the flame or at least in a high temperature zone containing sufficient oxygen to oxidize the contaminants.

Another object of the invention is to provide a counter-flow mixer drum into which latex additives or materials, such as ground rubber tires, may be introduced.

A corollary object of the invention is to provide a drum mixer of the foregoing character which is quieter in operation to render a safer work environment for asphalt workers and to render the asphalt plant less objectionable by community standards.

Other and further objects of the invention, together with the features of novelty appurtenant thereto, will appear in the detailed description set forth below.

In summary, a drum mixer is provided with a rotatable cylinder in which aggregates, reclaimed asphalt pavement and liquid asphalt are mixed to produce an asphaltic composition. The drum cylinder includes a first region, in which virgin aggregate is heated and dried by heat radiation and the stream of hot gases produced by a burner flame flowing in countercurrent flow to the aggregate itself to establish a highly beneficial heat transfer relationship. A second region doubles as combustion and mixing zones. In the mixing zone the reclaimed asphalt pavement and liquid asphalt is added and mixed with the aggregates. The combustion zone is formed along the center of the mixing zone by an elongated combustion assembly disposed along the central axis thereof. The combustion assembly and chamber extend from the discharge end of the drum through the mixing zone to the heating and drying zone to segregate the hot gases from the asphalt, thereby preventing degradation of the final product. The hot gas stream is withdrawn from the drum cylinder at the upstream or inlet end thereof and delivered as exhaust gas by ductwork to air pollution control equipment. In an alternative embodiment, a portion of the exhaust gas is redirected to the inlet end of the combustion assembly and added to the hot gas stream in a staged manner.

BRIEF DESCRIPTION OF THE DRAWINGS

In the following description of the drawings, in which like reference numerals are employed to indicate like parts in the various views.

DETAILED DESCRIPTION OF THE DRAWINGS

Figure 1:
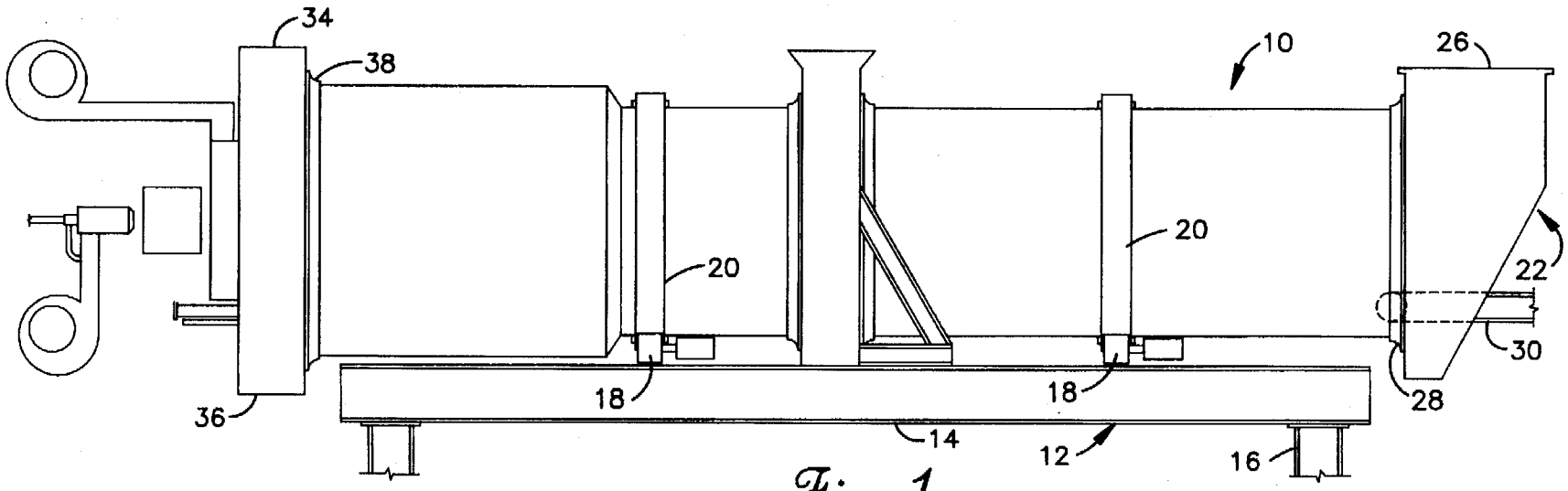
FIG. 1 is a side elevational view of an asphalt plant drum mixer constructed in accordance with a preferred embodiment of the invention, and shown connected to the aggregate feed conveyor, burner assembly and exhaust gas ductwork.

Referring now to the drawings in greater detail, the asphalt equipment of this invention includes a substantially horizontal drum cylinder 10 carried by a ground engaging support frame 12. The framework 12 comprises spaced apart, parallel beams 14 inclined from a horizontal orientation and supported by vertical legs 16. Optionally, the frame work may be mounted on axles for portability. Mounted on the parallel beams 14 are a plurality of motor driven rollers 18 which supportingly receive trunnion rings 20 secured to the exterior surface of the drum cylinder 10. Thus, rotation of the drive rollers 18 engaging the trunnion rings 20 causes the drum cylinder 10 to be rotated on its longitudinal axis. Optionally, the drum cylinder may be rotated by a chain or gear drive assembly (not shown).

Located at the inlet end of the drum cylinder 10 is a substantially closed inlet housing 22 illustrated in FIG. 1. The inlet housing 22 is fabricated as a fixed housing having a circular opening to receive the inlet end of the drum cylinder 10 and a bearing seal 28 bolted to the outer wall of the inlet housing 22 to permit rotation of the drum cylinder 10 within the inlet housing 22. The upper end of the inlet housing 22 is connected, via duct work, to a baghouse (not shown). The baghouse is connected to an exhaust fan to create a vacuum within the ductwork and the inlet housing 22, in order to draw air and exhaust or combustion gases from the inlet end of the drum cylinder 10. The lower end of the front wall of the inlet housing 22 has an opening which receives the discharge end of a material (or slinger) conveyor 30 adapted to deliver aggregate to the drum cylinder 10 from a storage hopper or stockpile (not shown).

The conveyor 30 extends into, and discharges within, the drum cylinder 10. The upper end of the inlet housing 22 includes an exhaust port 26 connected to ductwork, leading to conventional air pollution control equipment, such as a baghouse, to remove particulates from the gas stream.

Located at the outlet end of the drum cylinder 10, as illustrated in FIGS. 1–5, is a discharge housing 34. The discharge housing 34 includes a circular opening to receive the outlet end of the drum cylinder 10 and a bearing seal 38 bolted to the wall of the discharge housing 34 to permit rotation of the drum cylinder 10. The lower portion of the discharge housing 34 is fabricated as a funnel or discharge mouth 36 to direct asphaltic composition from the drum cylinder 10 to a material conveyor (not shown) for delivery of the product to a storage bin or transporting vehicle.

Figure 2:
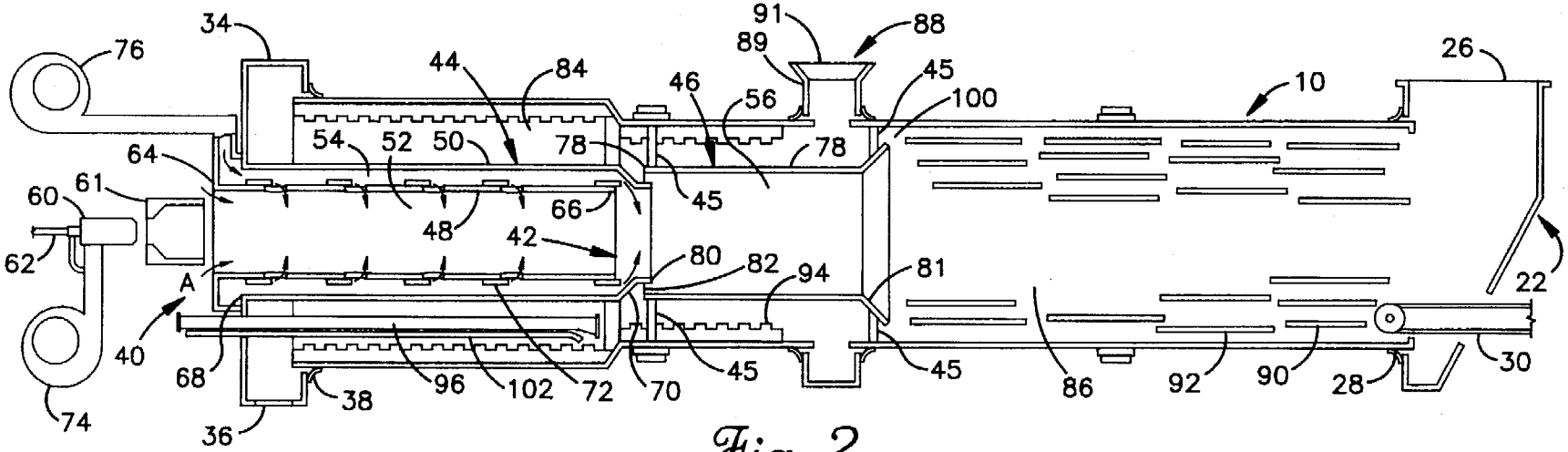
FIG. 2 is a side sectional view of the drum mixer connected with the burner assembly according to a first embodiment that includes a supplemental blower and an open burner.

Referring to FIG. 2, the discharge housing 34 includes a circular opening through a center thereof which receives a combustion assembly 40 that extends through the discharge housing 34 and into the drum cylinder 10. The combustion assembly 40 interjects a three-stage combustion zone 42 centrally into a mixing zone 84. The combustion assembly 40 includes a tubular elongated double-walled section 44 and a tubular single-walled section 46. The double-walled section 44 is formed with concentric inner and outer air tubes 48 and 50. The inner air tube 48 provides a primary combustion chamber or zone 52 and the outer or main air tube 50, provides a supplemental air chamber 54 (also referred to as a staging air zone). The single-walled section 46 provides a secondary combustion chamber or zone 56.

As illustrated in FIG. 2, the single-walled section 46 is fastened to, and centered within, the drum cylinder 10 via brackets 45 at front and back ends thereof. The single-walled section 46 rotates with the drum cylinder 10. The double-walled section 44 is supported in a cantilever fashion by a bracket proximate, but external, to the drum cylinder (not shown) and adjacent the discharge housing 34. Thus, the double-walled section 44 remains stationary throughout operation in this embodiment.

Optionally, the double-walled section 44 and the drum cylinder 10 may be configured such that the rear ends of the inner and outer air tubes project a substantial distance beyond the rear end of the discharge housing 34 (not specifically illustrated). In this option, the burner blower remains positioned at the rear ends of the inner and outer air tubes. The rear ends of the inner and outer air tubes are rotatably supported by a free-spinning trunnion assembly located at a point intermediate the burner blower and the discharge housing. Within the mixer drum, the front ends of the inner and outer air tubes are supported by brackets that are securely fastened to the inner wall of the drum cylinder, just as brackets 45 support the single-walled section 46. The brackets supporting the double-walled section 44 center the combustion assembly 40 within the drum cylinder 10. In operation, the drum cylinder and brackets transfer rotational force to the combustion assembly 40 causing it to rotate freely upon the free-spinning trunnion assembly supporting the rear end thereof.

Referring to FIG. 2, within the double-walled section 44, the inner air tube 48 includes a rear end 64 that extends beyond the discharge housing 34 and concentrically communicates with a discharge end of the burner blower 74 which forces air through a burner head 60 and an ignition port 61 and along the primary combustion chamber or zone 52. The ignition port 61 is lined with refractory material to retain heat and enhance burner performance. Typically, the combustion zone experiences low temperature areas or "cold spots" along its length, in which CO is produced. The refractory material absorbs heat from the flame and creates a hot zone within the ignition port 61. The temperature within this hot zone does not change significantly with instantaneous changes in the flame's temperature, thereby improving burner performance.

The inner air tube 48 extends along a longitudinal axis of the drum cylinder 10 and is formed with substantially the same diameter throughout its length. The inner air tube 48 is approximately one-third the length of the drum cylinder 10 (although this relative dimension may be varied as necessary), terminating at a front end 66, and includes adjustable air intakes 72 spaces about its perimeter and throughout its length. The air intakes 72 provide supplemental air at intervals along the flame to provide better mixing of the air and fuel.

As illustrated in FIG. 2, the diameter of the discharge end of the burner head 60 is smaller than the diameter of the inner air tube 48 to form an annulus therewith. As illustrated in FIG. 2, by arrow A, secondary air is drawn by the exhaust fan (connected to the baghouse) from outside the drum cylinder 10 around the perimeter of the ignition port 61 and into the primary combustion chamber 52. While the burner blower 74 is illustrated in FIG. 2 as an open air blower, optionally, the burner blower assembly may be constructed as an enclosed blower (see FIGS. 3–5). A fuel line 62 is disposed at a center of the rear end of the burner head 60 and is connected to an external fuel supply (not shown). As the burner blower 74 discharges air, it atomizes fuel from the fuel line 62 at the burner head 60 to maintain a flame directed longitudinally along the primary combustion chamber 52 into the drum cylinder 10.

The outer air tube 50 encompasses the inner air tube 48 and extends along the longitudinal axis of the drum cylinder 10. Rear ends 64 and 68 of the inner and outer air tubes 48 and 50 extend beyond the discharge housing 34 and communicate with a discharge end of a supplemental blower 76. The rear ends 64 and 68 of the inner and outer air tubes unite to direct exhaust gas and/or supplemental air from outside the drum cylinder along the supplemental air chamber 54 and into the air intakes 72. This supplemental air is forced by the supplemental blower 76. Optionally, the supplemental blower 76 may be eliminated and the supplemental air may be drawn from the atmosphere by the exhaust fan connected to the baghouse. As the supplemental air passes through the supplemental air chamber 54, it collects heat from the chamber walls. Thus, the supplemental air is heated before being injected into the air intakes 72, thereby improving combustion efficiency. The supplemental air also functions to cool the chamber walls thereby reducing the ambient temperature of the inner and outer air tubes 48 and 50.

A front end 70 of the outer air tube 50 extends beyond the front end 66 of the inner air tube 48 and is tapered to form an adjustable nozzle 80 having a diameter no greater than that of the inner air tube 48. The nozzle 80 is constructed to direct the flame into a narrow channel before leaving the double-walled section 44.

Figure 6:
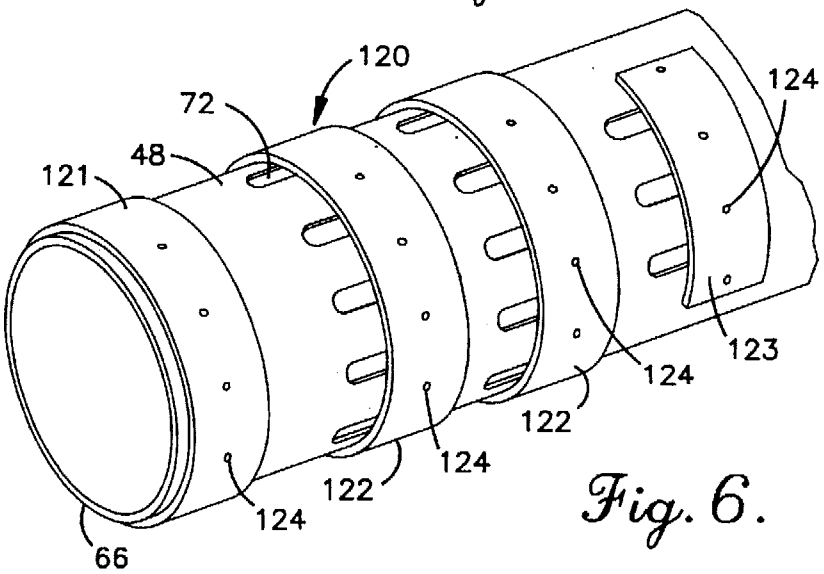
FIG. 6 is a side planar view of the inner air tube with sliding dampers thereon.

As illustrated in FIG. 6, the inner air tube 48 includes a sliding damper assembly 120 that may be formed in several manners. The damper assembly 120 includes a circular front sleeve 121 that is formed to fit snugly about a perimeter of the inner air tube 148. The front sleeve 121 slides longitudinally along, and is formed to extend beyond, the front end 66 of the inner air tube 48. When completely extended, the front sleeve 121 abuts against the nozzle 80 (FIG. 2) thereby entirely closing the air space between the front ends 66 and 70 of the inner and outer air tubes 48 and 50. The damper assembly 120 includes multiple damping sleeves 122 which are constructed similarly to the front sleeve 121, and are positioned adjacent each row of air intakes 72 about the circumference of the inner air tube 48. While the air intakes 72 are illustrated in FIG. 6 as slots, optionally, the air intakes may be formed in a variety of other configuration, such as circular holes. The damping sleeves 122 slide longitudinally along the inner air tube 48 to open entirely, open partially and close the air intakes 72, thereby adjusting the amount of supplemental air that is supplied to the primary combustion chamber 52. Each damping sleeve 121 and 122 is separately adjusted to vary the amount of supplemental air that is introduced through each circumferential row of air intakes 72.

Optionally, the damping sleeves 122 may be replaced with half-moon-shaped damping brackets 123 positioned on opposite sides of the inner air tube 48 immediately adjacent the air intakes 72. Each damping bracket 123 is sufficiently long to blanket half of one circumferential row of air intakes 72 about the perimeter of the inner air tube 48. The damping brackets 123 reduce the material necessary to accomplish damping. Within the damping assembly 120, the front damper sleeve 121 constitutes a complete circular sleeve to seal the air gap, when necessary, between the inner and outer air tubes 48 and 50. Further, the damping brackets 123, damping sleeves 122 and front damper sleeve 121 are fastened to the inner air tube 48 with bolts 124. The bolts 124 are affixed to the damping sleeves and brackets 121–123 and are received within slotted holes in the inner air tube 48. Each slotted hole in the inner air tube 48 is aligned parallel to the direction in which the dampers are slid. Optionally, the damping sleeves and brackets 121–123 may be fastened to the inner air tube 148 through weld-studs mounted on the dampers and projecting radially inward therefrom. The weld-studs are arranged to project through the air intakes and are threaded to receive a flat-bar washer and nut. The nuts secure the dampers to the inner air tube without requiring slotted holes separate from the air intakes.

To adjust the dampers, nuts upon the bolts 124 or on the weld-studs are loosened from within the primary combustion chamber 52 and the bolts 124 or weld-studs moved to a desired position, thereby moving the correspondingly affixed damping sleeve or bracket 121–123 therewith to cover a desired portion of the air intakes 72. Once positioned, the bolts 124 are retightened to hold the brackets or sleeves 121–123 in position.

Again referring to FIG. 2, within the combustion assembly 40, the single-walled section 46 includes a cylindrical heat-transmissive cover 78 formed concentric with the mixer drum 10 and aligned end-to-end with, and along a longitudinal axis common to, the double-walled section 44. The heat-transmissive cover 78 is formed of a high-temperature resistant material, such as stainless steel, and has a diameter roughly the same as that of the outer air tube 50. The heat-transmissive cover 78 includes a rear end 79 that loosely receives the nozzle 80 of the double-walled section 44 to yield an air-gap 82 therebetween. The nozzle 80 and the single-walled section 46 communicate such that air, flame and hot gas forcibly discharged from the nozzle 80 create a draft through the air-gap 82, thereby drawing air and blue-smoke from the mixing zone 84 into the single-walled section 46. The heat-transmissive cover 78 includes a front end 81 that is flared to direct and distribute the hot gas evenly into the heating and drying zone 86. The heat-transmissive cover 78 provides radiant heat to the RAP material that is introduced through a recycle feed assembly 88, while still separating the RAP material from the flame and hot gas stream emitted from the secondary combustion chamber 56.

Throughout the interior of the drum cylinder 10 are fixed various types of flighting 92 or paddles for the alternative purposes of lifting, veiling, guiding and mixing the material contained within the drum cylinder 10. The actions of the various flighting 92 are known to those skilled in the art and, accordingly, the flighting now disclosed are intended as workable embodiments but are not exhaustive of the various combinations which could be utilized with the invention.

At the inlet end of the drum cylinder 10, slanted guide paddles (not shown in detail, but generally designated 90) are fixed to the interior of the cylinder to direct material from the inlet housing 22 inwardly to various types of flighting 92. The flighting 92 may include conventional bucket flighting (not shown in detail) that are arranged in longitudinal rows with the axis of the drum cylinder 10. Each bucket flighting is open-topped and includes a bottom plate supported from the interior wall of the drum cylinder 10. When the drum cylinder 10 is rotated, aggregate material in the bottom of the drum cylinder 10 will be picked up by the bucket flighting and gradually spilled from the bucket as the bucket flighting rotate upward until all the material is discharged.

Slanted guide paddles 90 are also located proximate the downstream end of the hot gas stream and fixed to the interior of the cylinder to direct material from the heating and drying zone 86 of the drum cylinder 10 into the mixing zone 84. The slanted guide paddles 90 carry the material through an annulus 100 formed by the drum cylinder 10 and the flared front end 81 of the heat-transmissive cover 78.

A recycle feed assembly 88 is located downstream of the slanted guides and behind the flared front end 81 of the heat-transmissive cover 78. The recycle feed assembly 88 is not illustrated in detail as it is formed in a conventional manner, by which reclaimed asphalt material may be introduced into the drum cylinder 10. In one conventional feed assembly 88, a stationary box channel 89 encircles the exterior surface of the drum cylinder 10 and includes a feed hopper 91 to receive reclaimed asphalt pavement. The box channel 89 is bolted to angular bearing seals to permit rotation of the drum cylinder 10 within the encircling box channel 89 while still providing access to the interior of the drum cylinder 10. A plurality of scoops (not shown), which are secured to the outer wall of the drum cylinder 10, are radially spaced around the drum cylinder 10 and project into the space defined by the box channel 89. Each scoop includes an opening at the bottom thereof through the wall of the drum cylinder 10 to provide access to the inside thereof. Thus, reclaimed asphalt pavement is delivered through the feed hopper 91, through the scoops rotating within the box channel 89 and into the openings in the side of the drum cylinder 10.

Downstream of the recycle feed assembly 88, the interior surface of the drum cylinder 10 includes staggered rows of sawtooth flighting 94. The sawtooth flighting 94 are fixed upright on the drum cylinder 10 and comprise upright plates having irregular step-type upper surfaces to mix and stir material within the mixing zone 84 between the drum cylinder 10, and the outer air tube 50 and heat-transmissive cover 78. At the end of the mixing zone 84 is located the discharge housing 34 as previously discussed.

A screw conveyor 96 is mounted beneath the outer air tube 50 within the drum cylinder 10 and extends through the discharge housing 34. The screw conveyor 96 is connected to conventional equipment (not shown) for feeding binder material or mineral "fines" to the mixing zone. Optionally, a pneumatic blower may be used to inject fines into the mixing zone. Positioned alongside the screw conveyor 96, and likewise extended through the discharge housing 34, is an asphalt injection tube 102. The asphalt injection tube 102 is connected to conventional equipment (not shown) for spraying liquid asphalt into the mixing zone of the drum cylinder 10.

During operation, virgin aggregate from stockpile inventories is introduced by the material conveyor 30 to the inlet housing 22. The aggregate is delivered to the drum cylinder 10 as it is rotated by drive rollers 18. The guide paddles 90 direct the aggregate downstream to the flighting 92, such as the bucket flighting, with rotation of the drum cylinder 10. In the heating and drying zone 86, the flighting 92 lifts and drops the aggregate to create a curtain of falling aggregate across the interior of the drum cylinder 10. Subsequently, the aggregate is passed to the slant guide paddles 90 and moved past the annulus 100 between the drum cylinder 10 and flared front end 81 of heat-transmissive cover 78.

In the combustion assembly 40 at the rear end thereof, the fuel line 62 and burner blower 74 force the fuel and primary air through the burner head 60, to produce a radiant flame and a hot gas stream therefrom. The burner blower 74 forces the flame and hot gas stream along the primary combustion chamber 52 within the inner air tube 48. Secondary air is drawn about the discharge end of the burner head 60 by the exhaust fan connected to the baghouse. As illustrated in FIG. 2, the supplemental blower 76 directs supplemental air and/or exhaust gas into the supplemental air chamber 54 between the inner and outer air tubes 48 and 50. This supplemental air flows through the air intakes 72 and provides pre-heated oxygen at spaced points along a length of the flame, thereby increasing the combustion efficiency. Alternatively, the supplemental air may be drawn into the supplemental air chamber and through the air intakes 72 by the exhaust fan and the flame and hot gas stream being blown past the air intakes 72 by the burner blower 74. The supplemental air reduces the overall amount of air that is required by the flame since this air is pre-heated and injected into the flame at intermediate points therealong, thereby increasing the drum capacity and reducing the baghouse requirements.

Further, the supplemental air flowing between the inner and outer air tubes 48 and 50 cools the walls of both air tubes to allow stainless steel to be used to form the inner tube wall, instead of a more expensive higher heat resistant material. The supplemental air also provides precise control over the temperature within combustion chamber and over the heat radiated therefrom into the heating/drying and mixing zones 86 and 84.

As the flame and the hot gas stream exit the primary combustion chamber 52, the adjustable nozzle 80 redirects the flame along the center of the secondary combustion chamber 56 formed by the heat-transmissive cover 78. The nozzle 80 consolidates the flame and hot gas stream into a narrow channel thereby accelerating the flow rate of the hot gas stream past the air gap 82 into the secondary combustion chamber 56. By accelerating the flow rate, the nozzle 80 increases the draw through the air-gap 82 from the mixing zone 84. Consequently, the blue-smoke that would otherwise collect in the mixing zone 84 is drawn into the secondary combustion chamber 56 and burnt.

The heat-transmissive cover 78 provides radiant heat to the mixing zone 84 and to the RAP material injected through the recycle feed assembly 88 while isolating the RAP material from the flame and hot gas stream. The path of the hot gas stream is expanded by the flared front end 81 of the heat-transmissive cover 78 before the hot gas stream contacts and passes through the aggregate material. In this manner, the virgin aggregate is veiled through a hot gas stream that is distributed throughout the heating/drying zone 86, but not through the flame itself. By isolating the aggregate from the flame, the heat-transmissive cover 78 prevents any flame quenching or other problems that would otherwise occur if the aggregate passes directly through the flame. The flared end 81 prevents veiling aggregate within the heating/drying zone 86 from collecting in the heat-transmissive cover 78.

The hot gas stream flows through the interior of the drum cylinder 10 to the inlet end of the drum cylinder 10 to heat and dry aggregate material. The hot gas stream and any dust particles which may be entrained in the gas pass through the exhaust port 26 of the inlet housing 22 to air pollution control equipment, such as the baghouse, where the dust is removed from the process gas by fabric filtration. These particles are minimized since only the aggregate material is exposed to the hot gas stream, not the mixture of liquid asphalt, RAP and fines. Eliminating the RAP, fines and VOCs within the exhaust air lengthens the life of the bags in the baghouse.

The inclined orientation of the drum cylinder 10 causes the aggregate to move downstream through the heating/drying and mixing zones 86 and 84. Once the virgin aggregate is dried and heated, it is passed along with the RAP material by the slant guide plates to the sawtooth flightings 94. Reclaimed asphalt is delivered by conveyor through the feed hopper to the box channel 89 around the drum cylinder 10. The reclaimed material is then picked up by the scoops and delivered through scoop openings to the interior of the drum cylinder 10. It should be noted that the location of the recycle feed assembly 88, the direction of flow of the combined aggregate and recycle material within the drum cylinder 10, and the heat-transmissive cover 78 isolate the reclaimed material from any contact with the flame from the burner head 60 and the generated hot gas stream. Material is thus exposed to the radiant heat flux through the outer air tube 44 and the heat-transmissive Cover 78 without direct contact with the hot gas stream.

The aggregate and recycle material are then mixed and stirred by the sawtooth flighting 94 in the mixing zone 84 formed between the heat-transmissive cover 78, outer air tube 50 and drum cylinder 10. Dust binder or mineral fines are delivered through the screw conveyor 96 while liquid asphalt is sprayed through the injection tube 102. The aggregate, RAP, binder and liquid asphalt are therefor combined to form an asphaltic composition directed to the discharge mouth 36 of the discharge housing 34. The final asphaltic product may then be held in temporary storage facilities or delivered to a transport vehicle for use in pavement construction.

As in the case with the recycle material, the liquid asphalt and the mineral fines are effectively isolated from the flowing hot gas stream within the drum cylinder 10. Since the normally troublesome materials of asphalt production, such as the recycle material, liquid asphalt and dust binder, are shielded from contact with the flame of the burner head 60 and with the hot gas stream, degradation of the asphalt is virtually eliminated. Such a highly desirable result is achieved by providing a combustion assembly 40 that shields the recycle feed assembly 88, the dust binder screw conveyor 96, and the liquid asphalt injection tube 76, from the flame and hot gas stream. Also, a shortened overall assembly is achieved by providing a combustion assembly 40 that creates a combustion zone 42 within the same length of the drum cylinder as the mixing zone 84.

Figure 3:
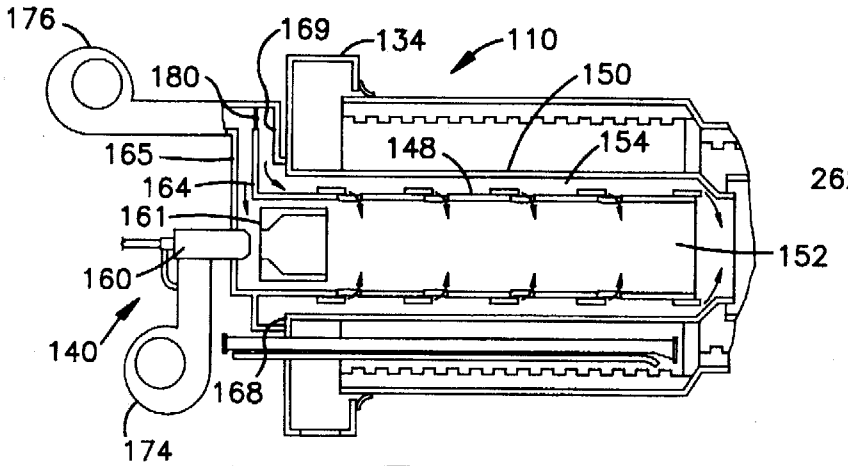
FIG. 3 is a side sectional view of the aggregate discharge end of the drum mixer connected with the burner assembly according to a second embodiment that includes an enclosed burner.

FIG. 3 illustrates an alternative embodiment for the discharge end 110 of the mixer drum, in which the burner assembly has been modified to form an enclosed system. In this embodiment, the rear end 164 of the inner air tube 148 extends beyond the rear end 168 of the outer air tube 150. The rear end 164 of the inner air tube 148 encloses the ignition port 161 and tightly receives the front end of the burner head 160. The rear end 168 of the outer air tube 150 is enclosed and tightly receives a rear portion of the inner air tube 148. By enclosing the rear ends 164 and 168 of the inner and outer air tubes 148 and 150, atmospheric air is prevented from being drawn into the combustion assembly 140 and about the burner blower 174.

The rear ends 164 and 168 of the air tubes are coupled to inner and outer air inlet conduits 165 and 169 which combine to receive jointly the discharge end of a supplemental blower 176. The inner and outer air inlet conduits 165 and 169 direct forced supplemental air from the supplemental blower 176 to the combustion assembly 140. Within the outer air conduit 169, a damper 180 is inserted to separate the supplemental air chamber 154 from the supplemental blower 176 and to control the percentage of forced supplemental air that is directed into the supplemental air chamber 154. The forced supplemental air that does not pass the damper 180 is routed into the rear end 164 of the inner air tube 148, where it passes through and around the ignition port 161 and into the primary combustion chamber 152.

During operation, the embodiment of FIG. 3 works substantially the same as the embodiment of FIG. 2, except that the secondary air is not freely drawn around the burner blower 174. Instead, the amount of supplemental air is controlled entirely by the supplemental blower 176 and the damper 180. In this manner, the burner blower 174, supplemental blower 176 and damper 180 precisely control the air delivered to the primary combustion chamber 152 at its rear end and through the air intakes along its length.

Figure 4:
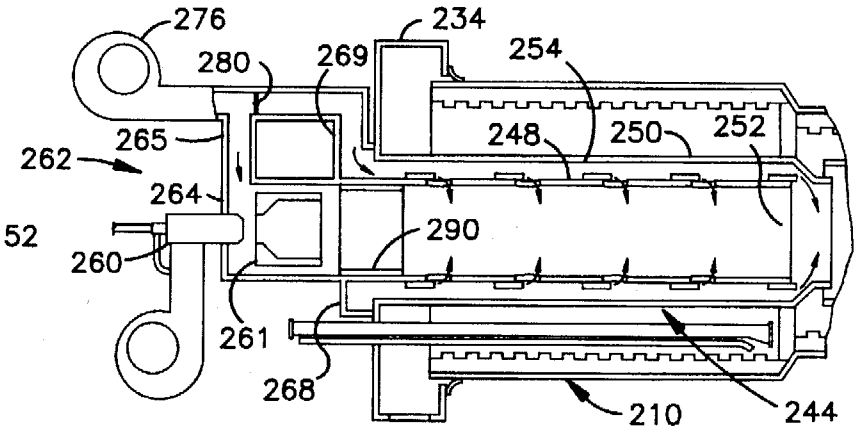
FIG. 4 is a side sectional view of the aggregate discharge end of the drum mixer connected with the burner assembly according to a third embodiment that includes an enclosed burner.

FIG. 4 illustrates an alternative embodiment, which substantially resembles that of FIG. 3, except that the inner air tube 248 has been lengthened. In this embodiment, the inner air tube 248 projects beyond the discharge housing 234 sufficiently to accept the burner assembly 262 (i.e., the burner head 260 and ignition port 261) at a position behind and outside the discharge housing 234. In this configuration, the burner assembly 262 acts as a counter weight partially offsetting the weight of the front end of the double-walled section 244 which exerts a prying force upon the supporting bracket proximate the discharge housing 234. As explained above, the entire combustion assembly 240 may be supported by a bracket proximate the discharge housing 234, and external to the drum cylinder 210. This bracket experiences a cantilever force from that portion of the inner and outer air tubes 248 and 250 extending into the drum cylinder 210. The burner assembly 262 is positioned behind the support bracket to compensate for this cantilever force.

Optionally, a refractory material 290 is inserted within the inner air tube 248 proximate the discharge housing 234 to line a portion of the inner air tube 248. The refractory material 290 retains heat from the flame and thus, maintains a relatively constant temperature within the region surrounded by the refractory material 290. As explained above, the refractory material 290 prevents "cold spots" from existing within the combustion chamber in which CO is typically produced.

Still referring to FIG. 4, the rear ends 264 and 268 of the inner and outer air tubes 248 and 250 receive inner and outer air conduits 265 and 269, respectively. The inner and outer air conduits 265 and 269 join to accommodate a discharge end of the supplemental blower 276. A damper 280 is formed within the outer air conduit 269 and controls the amount of air that passes to the supplemental air chamber 254 from the supplemental blower 276 and that ultimately is supplied to the primary combustion chamber 252.

Figure 5:
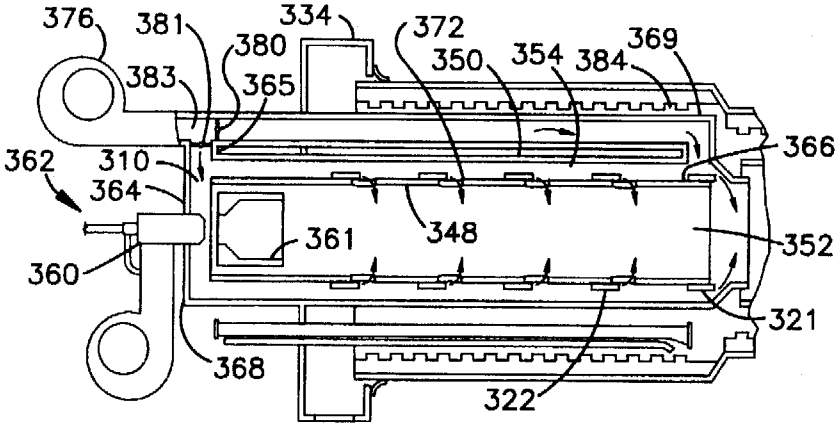
FIG. 5 is a side sectional view of the aggregate discharge end of the drum mixer connected with the burner assembly according to a fourth embodiment that includes an enclosed burner and front air inlet conduit.

FIG. 5 illustrates another embodiment for the combustion assembly having a closed burner assembly 362. In FIG. 5, the rear end 364 of the inner air tube 348 is open and accommodates the ignition port 361. The rear end 368 of the outer air tube 350 encloses the burner assembly 362 tightly about the burner head 360. The rear end 368 of the outer air tube 350 extends sufficiently beyond the rear end 364 of the inner air tube 348 to form a passageway 310 therebetween in order that a rear end of the supplemental air chamber 354 communicates with the rear end of the primary combustion chamber 352.

Front and rear inlet conduits 369 and 365 are received at front and rear ends of the outer air tube 350, respectively. The front inlet conduit 369 passes through a portion of the mixing zone 384. The inlet conduits 365 and 369 merge at a point 383 proximate the discharge end of the supplemental blower 376 and receive forced air therefrom. Dampers 380 and 381 are positioned within the conduits 369 and 365, respectively, to control the amount of forced air directed along each conduit and into opposite ends of the supplemental air chamber 354. As in each previous embodiment, the inner air tube 348 includes air intakes 372 about its perimeter and along its length.

When in operation, the supplemental blower 376 forces air to the point 383 where it is divided between the front and rear conduits 369 and 365 in accordance with the positions of the dampers 381 and 380. A first portion of this air travels past the damper 380 along the front inlet conduit 369 and is introduced into the supplemental air chamber 354 proximate the front end 366 of the inner air tube 348. The first portion of the air travels along the supplemental air chamber 354 in a direction opposite to that of the hot gas stream, while being introduced into the primary combustion chamber 352 through the air intakes 372 and about the front end 366 of the inner air tube 348.

As is illustrated in FIG. 5, the front damping sleeve 121 is positioned to close the air gap between the front ends of the inner and outer air tubes. Thus, as this first air portion travels along the front inlet conduit 369, it is directed back along the supplemental air chamber 354 and is continuously heated. Preheating the air improves the burner efficiency. Accordingly, the air introduced into the primary combustion chamber 352 through air intakes 372 proximate the front end 366 of the inner air tube 348 is cooler than air introduced through air intakes 372 near the rear end 364 thereof. Similarly, air introduced into the primary combustion chamber around the rear end 364 is relatively hot.

A second portion of the supplemental air travels past the damper 381, along the rear inlet conduit 365, through the passageway 310 and into the primary combustion chamber 352. This second portion of the supplemental air is relatively cool until it is commingled with hot air flowing from the rear end of the supplemental air chamber 354. Thus, the first and second portions of the air introduced into the rear end of the primary combustion chamber 352 are injected as pre-heated air. The dampers 380 and 381 and damping sleeves 321–323 control the amount of air introduced at each air intake 372 along the primary combustion chamber 352 to obtain a desired mixture of clean air throughout.

Figure 7:
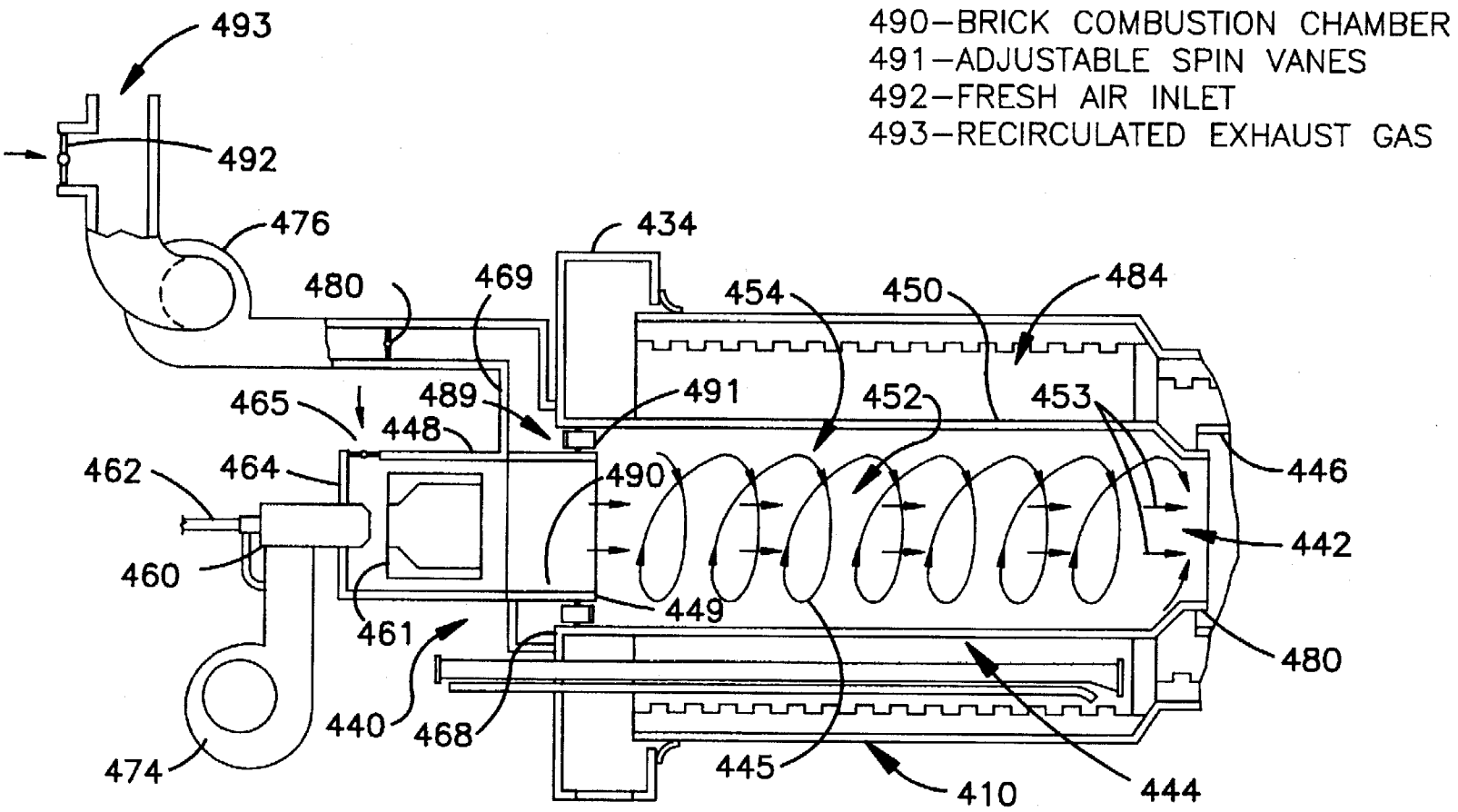
FIG. 7 is a side sectional view illustrating an alternative embodiment.

FIG. 7 illustrates an alternative embodiment in which a combustion assembly 440 has been modified by removing an inner air tube (as illustrated in FIG. 2) therefrom. The combustion assembly 440 maintains a three stage combustion zone 442 centrally located within a mixing zone 484 (the structure of the overall system downstream of the combustion assembly 440 remains unchanged and thus is not illustrated). The combustion assembly 440 includes a single main air tube 450 and a tubular single-walled section 446. The single main air tube 450 extends through a discharge housing 434 and along the longitudinal axis of a drum cylinder 410. A nozzle 480 on the front end of the main air tube 450 is received within the rear end of the secondary air tube 446. A rear end 468 of the main air tube 450 is located proximate the discharge housing 434 and communicates with a discharge end of a supplemental blower 476 via an air conduit 469. As will be explained in more detail below, the main air tube 450 maintains two separate zones or chambers therein, namely a primary combustion zone or chamber 452 proximate its central axis and a staging air zone 454 (also referred to as a supplemental air chamber) remote from the axis and extending about the inner periphery of the main air tube 450. By separating the mixing and combustion zones, the main air tube 450 reduces any chemical activity that might promote generation of pollutants. Furthermore, any pollutants produced in the mixing zone are induced into the secondary combustion zone via the venturi formed between the secondary air tube 446 and the nozzle 480 as described above in connection with the preceding embodiments. These pollutants are thereafter oxidized to form harmless $CO_2$ and water vapor.

An input air chute 448 is aligned concentrically along a common axis with the main air tube 450 to communicate therewith. The input air chute 448 includes a forwardmost end 449 located proximate, and slightly within, the rearmost end 468 of the main air tube 450. The input air chute 448 extends rearward beyond the conduit 469 and includes a rear end 464 which encloses an ignition port 461. The rear end 464 of the input air chute 448 further receives a burner head 460 which is connected to a primary blower 474. The input air chute 448 includes a damper 465 located proximate its rear end 464 to control an amount of external air delivered into the input air chute 448, in addition to the air drawn through the blower 474. Air flowing through the burner 460, the ignition port 461, and the damper 465 represents primary air which travels through the input air chute 448 and along the center of the main air tube 450. The input air chute 448 may be constructed with a forwardmost region 490 formed of a brick refractory material. The ignition port 461 may also be constructed of brick or other refractory material.

A basic combustion system is formed by the blower 474, the burner 460, the input air chute 448, the ignition port 461 and the primary combustion zone or chamber 452. The foregoing structure affords a low pressure burner system, with a turbo blower. The burner utilizes an ignition port to provide a high temperature zone to enhance combustion and to aid in flame holding. The ignition port communicates with a combustion chamber which provides a means for increasing re-radiation back into the active portion of the flame resulting in better and cleaner combustion. Further, this arrangement permits the isolation of this portion of the system which permits operating in the reducing portion of the combustion spectrum thereby reducing flame temperature and the availability of oxygen. Such reductions further limit the tendency to form oxides of nitrogen.

The supplemental blower 476 receives exhaust gases at point 493 from a branch line (not shown) interconnecting the supplemental blower 476 with the exhaust port (not shown) proximate the discharge end of the assembly. Optionally, exhaust gas may be drawn from the clean side of the baghouse. These exhaust gases contain a high moisture content from the dried aggregate. A damper 492 is provided within the inlet line to the supplemental blower 476 to provide a controlled amount of external air (and thus oxygen) into the stream of exhaust gas delivered to the supplemental blower 476. The external air from damper 492 and the exhaust gases introduced at point 493 are combined to form a supplemental air stream which is delivered along the conduit 469 to the staging air or secondary combustion zone 454.

The forwardmost end 449 of the input air chute 448 is interconnected with the rearward end 468 of the main air tube 450 via a plurality of adjustable spin vanes 491. The spin vanes 491 project radially outward about the periphery of the input air chute 448 and spans the region between the input air tube 448 and main air tube 450. Each vane 491 is oriented to form an angle with the longitudinal axis of the main air tube 450 such that, when the supplemental air stream is introduced at point 489, it is directed along a spiral path against and along the inner periphery of the main air tube 450 to form a cyclonic flow. This spiral path or cyclonic flow is generally illustrated by the arrow 445. The supplemental air stream is introduced in this spiral manner to maintain such air against the main air tube 450 along a length thereof as a substantially separate zone apart from the primary combustion zone 452. This separate outer zone corresponds to the staging air zone 454, along the length of the main air tube 450. As the supplement air within the staging air zone 454 spirals about path 445, the primary combustion air maintains a substantially linear path of travel identified by arrows 453.

As the supplemental air stream travels along the staging air zone 454, it gradually mixes with the air (also referred to as the hot gas stream) within the primary combustion zone 452 along a length thereof. As the external air and exhaust gases within the staging air zone 454 fall out of this spiral path and thus out of the staging air zone 454, oxygen therein mixes with and is delivered to the hot gas stream along the length of the primary combustion zone 452, in a staged manner. As explained above, introducing air in a staged manner along the length of the primary combustion zone maximizes combustion efficiency and minimizes CO content within the exhaust gases and reduces NOX. In addition, the cyclonic flow by the supplemental air stream somewhat cools the air tube 450.

A supplemental combustion system is provided by the recirculated air introduced at point 493, the new air introduced through the damper 492, the supplemental blower 476, the damper 480, the conduit 469 and the staging air zone 454. This supplemental combustion system allows an efficient means of lowering the flame temperature by dilution via the supplemental air stream containing recirculated combustion products. Additionally, the inert make up of the recirculated combustion products reduces the oxygen content within the supplemental air stream thereby reducing formation of oxides of nitrogen. The damper 492 may introduce additional oxygen to complete combustion when the basic combustion system noted above is operated with an amount of oxygen insufficient to afford complete combustion (i.e. running under a reduced or starved condition).

The primary combustion and staging air zones 452 and 454, are maintained separate, primarily, due to the fact that the supplemental air stream experiences significant centrifical forces thereon as it spirals along the periphery of the main air tube 450. The separating effects afforded by these centrifical forces are maximized by utilizing a supplemental air stream having a greater density than the primary combustion zone.

In particular, the hot gas stream within the primary combustion zone 452 is delivered via the burner 460, blower 474 and ignition port 461. As such, the hot gas stream is delivered at an extremely high temperature and with a relatively low moisture content. Hence, the hot gas stream propelled along the core of the main air tube 450 has a relatively low density. As the hot gas stream is emitted from the combustion chamber, it collects moisture from the aggregate to form exhaust gas. A portion of this exhaust gas is recirculated to point 493 and delivered to the supplemental blower 476. The exhaust gases delivered at point 493 have absorbed a significant amount of moisture from the aggregate and cooled somewhat from a previous temperature within the combustion zone. Hence, the exhaust gases delivered at point 493 are characterized by having a density substantially greater than the density of hot gases delivered from the ignition port 461. While external air is added to the exhaust gases at damper 492, the volume of air so added is relatively small to ensure that the density of the supplemental air stream delivered at point 489 through the spin vanes 491 is sufficiently greater than the density of gases delivered from the ignition port 461. Thus, the supplemental air stream delivered at point 489 is more susceptible to centrifical forces as compared to a less dense air stream.

The spin vanes 491 are oriented at an angle sufficient to induce a necessary centrifical force upon the supplemental air stream to maintain this air stream within the staging air zone 454 for a desired distance. As the supplemental air stream travels along the staging air zone 454, air proximate the boundary between the staging air zone 454 and primary air zone 452 intermingles with the hot gas stream within the primary combustion zone 452. This interference causes air to fall out of the spiral pattern and thus mix with the hot gases within the primary combustion zone 452. This interference occurs along the length of the tubular boundary between the primary combustion zone 452 and the staging air zone 454. As air falls out of the spiral pattern, oxygen therein is delivered to the primary combustion zone 452 along its length, thereby achieving a staging effect of providing oxygen along a length of the combustion zone.

The introduction of a supplemental air stream in the foregoing manner reduces the amount of heat experienced by the main air tube 450. As noted above, the supplemental air stream within the staging air zone 454 contains a high moisture content and thus is capable of absorbing a large amount of radiant heat. As the hot gases travel along the primary combustion zone 452, these gases irradiate heat outward into the staging air zone 454. A portion of this radiant heat is absorbed by the supplemental air stream and redirected into the primary combustion zone 452 as the supplemental air stream mixes therewith in the staged manner. Hence, a portion of the radiant heat is redirected into the primary combustion zone 452 and outward from its discharge end. By redirecting such radiant heat in this manner, a controlled amount of heat is directly induced upon the main air tube 450 just sufficient to provide the necessary amount of radiant heat to the mixing zone. Hence, the main air tube 450 may be constructed of a lighter material while still providing sufficient radiant heat to the mixing zone. The absorption of radiant heat becomes more critical when using fuel oil within the burner 460 as compared to natural gas. Thus, the embodiment of FIG. 7 provides a staged combustion zone which is able to utilize a relatively thin walled main air tube 450.

An optimal combustion ratio is achieved by delivering excess air at damper 492 into the exhaust gas stream to provide additional oxygen into the supplemental gas stream and thus stagedly into the primary combustion zone 452. During operation, the damper 465 and the primary blower 474 may be set to provide less oxygen to the hot gas stream than is necessary to burn all of the fuel therein. In this manner, the hot gas stream is somewhat starved for oxygen. The remaining necessary oxygen is provide through damper 492 within the supplemental air stream and staging air zone 454 to achieve an optimal staged combustion ratio.

The heating and drying zone, downstream of the combustion zone, is the primary region within which heat transfer occurs. Within this drying region, some heat transfer occurs through radiation as a result of the dust cloud therein, which increases emissivity of the hot gas cloud. In addition, veiling of material through the hot gas stream within the drying zone further promotes heat transfer through convection. The combustion reactions within the hot gas stream have substantially completed before the hot gases reach the drying zone, and thus quenching of the hot gas stream by the veiled material does not produce pollutants such as aldehydes and CO.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Having thus described my invention, I claim:

1. A method for continuously producing an asphaltic composition product from asphalt and aggregate within a drum mixer including a rotatable cylinder having first and second ends with an internal passageway communicating therebetween, said passageway including a multi-stage combustion zone surrounded by a mixing zone, said multi-stage combustion zone including a primary combustion zone extending along a longitudinal axis of said multi-stage combustion zone and a staging air zone surrounding said primary combustion zone, said method comprising the steps of:

rotating said cylinder about a central longitudinal axis thereof;

introducing aggregate and liquid asphalt into said cylinder;

mixing said liquid asphalt and aggregate in said mixing zone;

delivering a hot gas stream into an inlet end of said primary combustion zone which flows through said heating/drying zone to heat and dry said aggregate;

delivering a supplemental air stream into an inlet end of said staging air zone;

isolating said mixing zone from said hot gas stream throughout said multi-stage combustion zone; and discharging said asphaltic composition from said mixing zone.

2. The method as set forth in claim 1, further comprising the steps of:

directing said hot gas stream into said inlet end of said primary combustion zone along a primary path at a first angle to said longitudinal axis; and directing said supplemental air stream into said inlet end of said staging air zone along a supplemental path at a second angle with said longitudinal axis.

3. The method as set forth in claim 1, further comprising the steps of:

introducing, in a staged manner, supplemental air from said staging air zone into, and along a length of, said primary combustion zone.

4. The method as set forth in claim 1, wherein said hot gas stream has a lower moisture content than said supplemental air stream.

5. The method as set forth in claim 1, wherein said supplemental air stream is delivered along a spiral path about said staging air zone.

6. The method as set forth in claim 1, further comprising the step of:

forming, said supplemental air stream from external air and exhaust gases from said second end.

7. The method as set forth in claim 1, further comprising the step of delivering said hot gas stream to said inlet end of said primary combustion zone in an oxygen starved state and providing additional oxygen thereto along a length of said primary combustion zone from said staging air zone, to improve efficiency.

8. The method as set forth in claim 1, including the step of adding reclaimed asphalt material directly to said mixing zone isolated from said hot gas stream.

9. The method as set forth in claim 1, further comprising the sub-steps of:

introducing portions of said supplemental air stream into said primary combustion zone at spaced intakes along a length thereof.

10. The method as set forth in claim 1, including the step of limiting an amount of radiant heat delivered from said primary combustion zone to an outer wall of said multi-stage combustion zone by directing said supplemental air stream through said staging air zone along an inner periphery of said wall.

11. The method as set forth in claim 1, including the step of providing radiant heat to said mixing zone from walls of said multi-stage combustion zone.

12. The method as set forth in claim 1, including the step of preheating said mixing zone with radiant heat emitted from walls of said multi-stage combustion zone.

13. The method as set forth in claim 1, including the step of preheating said supplemental air stream prior to delivery to said multi-stage combustion chamber.

* * * * *